US007762176B2

(12) United States Patent
Vu

(10) Patent No.: US 7,762,176 B2
(45) Date of Patent: Jul. 27, 2010

(54) RADIAL PISTON PUMP WITH A ROLLER PLUNGER

(75) Inventor: Ngoc-Tam Vu, Ludwigsburg (DE)

(73) Assignee: Continental Automotive GmbH, Hannover (DE)

( * ) Notice: Subject to any disclaimer, the term of this patent is extended or adjusted under 35 U.S.C. 154(b) by 502 days.

(21) Appl. No.: 11/576,798

(22) PCT Filed: Jul. 27, 2005

(86) PCT No.: PCT/EP2006/053671

§ 371 (c)(1),
(2), (4) Date: Aug. 22, 2007

(87) PCT Pub. No.: WO2006/037673

PCT Pub. Date: Apr. 13, 2006

(65) Prior Publication Data

US 2008/0034959 A1 Feb. 14, 2008

(30) Foreign Application Priority Data

Oct. 6, 2004 (DE) ..... 10 2004 048 711

(51) Int. Cl.
*F04B 1/04* (2006.01)
*F04B 49/00* (2006.01)

(52) U.S. Cl. ..... 92/72

(58) Field of Classification Search ..... 92/72, 92/129, 165 R, 165 PR
See application file for complete search history.

(56) References Cited

U.S. PATENT DOCUMENTS 5,307,769 A * 5/1994 Meagher et al. ..... 123/90.5
5,415,533 A * 5/1995 Egger et al. ..... 92/129
5,491,631 A 2/1996 Shirane et al. ..... 364/424.04
6,195,763 B1 2/2001 Mayer et al. ..... 714/25
6,302,659 B1 * 10/2001 Parker et al. ..... 92/72
6,799,954 B2 * 10/2004 Ikegami et al. ..... 92/129

(Continued)

FOREIGN PATENT DOCUMENTS

DE 4411326 A1 9/1995

(Continued)

OTHER PUBLICATIONS

International Search Report PCT/EP2005/053671, 4 pages, Oct. 26, 2005.

(Continued)

*Primary Examiner*—Thomas E Lazo
(74) *Attorney, Agent, or Firm*—King & Spalding L.L.P.

(57) ABSTRACT

A radial piston pump has a pump housing (1) and at least one pump unit (2) with a pump piston (3) and a cylinder (4) wherein the pump piston (3) can be mounted such that it can be moved backwards and forth, wherein the pump unit (2) can be driven by means of a camshaft (5) mounted in the pump housing (1); and a roller plunger (6) is arranged between the camshaft (5) and the pump unit (2), consisting of a plunger (7) and a roller (8), wherein the plunger has a guide area (9) which is used to guide it a first slot-shaped guide groove (10) of the cylinder insert (4). The roller plunger (6) is thus reliably prevented from rotating inside the cylinder insert (4). The radial piston pumps are particularly suited for high rotational speeds occurring in high-pressure fuel pumps.

19 Claims, 4 Drawing Sheets

U.S. PATENT DOCUMENTS

| | | | | |
|---|---|---|---|---|
| 6,807,951 | B2 | 10/2004 | Fehlmann et al. | 123/508 |
| 7,311,087 | B2 * | 12/2007 | Shaull et al. | 123/509 |
| 2004/0109775 | A1 | 6/2004 | Hartsleben et al. | 417/439 |
| 2005/0203684 | A1 | 9/2005 | Borgesson | 701/36 |

FOREIGN PATENT DOCUMENTS

| | | | |
|---|---|---|---|
| DE | 19723079 | C1 | 11/1998 |
| DE | 19841260 | A1 | 3/2000 |
| DE | 19941440 | A1 | 3/2001 |
| DE | 10107367 | A1 | 9/2002 |
| DE | 10345089 | A1 | 4/2005 |
| DE | 10355028 | A1 | 6/2005 |
| DE | 10297674 | T5 | 7/2005 |
| EP | 1028252 | A2 | 8/2000 |
| EP | 1319831 | A2 | 6/2003 |
| EP | 1413749 | A2 | 4/2004 |

OTHER PUBLICATIONS

Written Opinion Supplementary Sheet, PCT/EP2005/053671, 1 page.

International Search Report with Written Opinion PCT/EP2005/053671, 11 pages, Oct. 26, 2005.

* cited by examiner

RADIAL PISTON PUMP WITH A ROLLER PLUNGER

CROSS-REFERENCE TO RELATED APPLICATIONS

This application is a U.S. national stage application of International Application No. PCT/EP2005/053671 filed Jul. 27, 2005, which designates the United States of America, and claims priority to German application number DE 10 2004 048 711.1 filed Oct. 6, 2004, the contents of which are hereby incorporated by reference in their entirety.

TECHNICAL FIELD

The invention relates to a radial piston pump.

BACKGROUND

Such a radial piston pump has a pump housing and at least one pump unit comprising a pump piston and a cylinder insert, in which the pump piston is mounted such that it can be moved to and fro, it being possible for the pump unit to be driven by way of a camshaft mounted in the pump housing and for a roller plunger to be arranged between the camshaft and the pump unit.

A generic radial piston pump is already known from EP 1 319 831 A2. The radial piston pump has a camshaft, which moves a piston arranged in the pump housing and/or cylinder head by way of a roller plunger. The roller plunger is arranged between the camshaft and the pump piston and features a plunger as well as a roller which are essentially directly arranged in the plunger in a rotatable manner. The outer peripheral area of the roller rolls on the outer peripheral area of the camshaft. This produces especially low friction at the point of contact between the roller and the camshaft, thereby minimizing the wear of the components.

Such a solution is however disadvantageous in that the roller plunger is only guided in an axial direction. It is however not possible to prevent the roller plunger from rotating about its longitudinal axis. This means that the roller of the roller plunger can no longer roll accurately on the cam of the camshaft, which can result, in an extreme case, in a total failure of the radial piston pump.

SUMMARY

The object of the present invention, starting herefrom, is to provide an improved radial piston pump compared with the prior art, which reliably prevents the roller plunger from twisting.

According to an embodiment, a radial piston pump may have a pump housing and at least one pump unit with a pump piston and a cylinder insert in which the pump piston is mounted such that it can be moved to and fro, it being possible for the pump unit to be driven by means of a camshaft mounted in the pump housing, and a roller plunger comprising a plunger and a roller to be arranged between the camshaft and the pump unit, wherein the plunger comprises a guide area, with which said plunger is guided in a first slot-shaped guide groove of the cylinder insert

BRIEF DESCRIPTION OF THE DRAWINGS

Exemplary embodiments and further advantages of the invention are explained below with reference to the drawings, in which.

Figure 1:
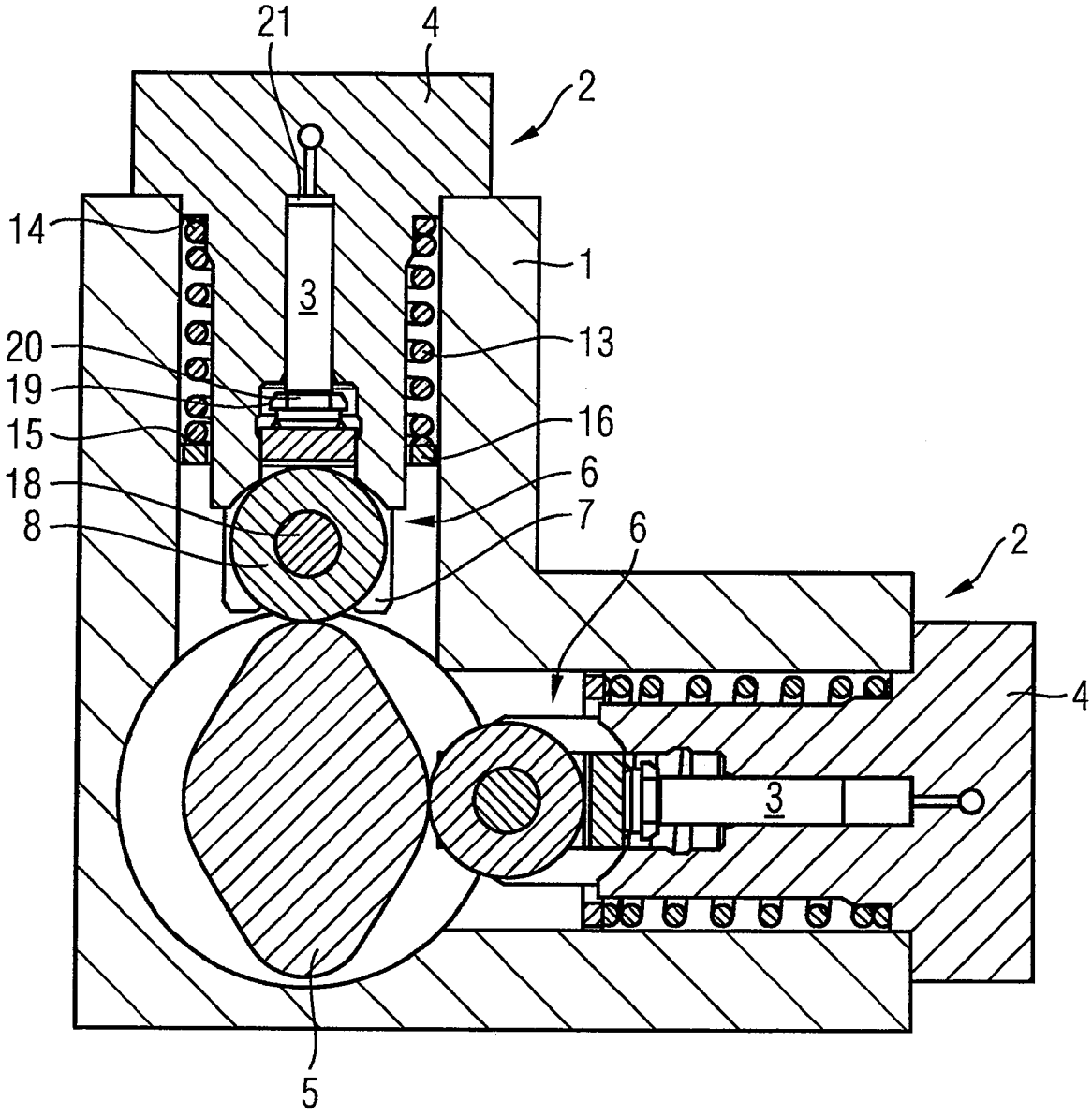
FIG. 1 shows a schematic radial section through a radial piston pump according to an embodiment.

The figures in question are significantly simplified representations in each instance, whereby only the essential components necessary to describe the invention are shown.

DETAILED DESCRIPTION

The radial piston pump according to an embodiment may have a pump housing and at least one pump unit comprising a pump piston and a cylinder insert in which the pump piston is mounted such that it can be moved to and fro, it being possible for the pump unit to be driven by way of a camshaft mounted in a pump housing and for a roller plunger, comprising a plunger and a roller, to be arranged between the camshaft and the pump unit, is characterized in that the plunger features a guide area with which said plunger is guided in a first slot-shaped guide groove of the cylinder insert. The guidance of the plunger in a first slot-shaped guide groove allows the roller plunger to be safeguarded against twisting about its longitudinal axis. The slot-shaped guide groove can be introduced into the cylinder insert in a simple and cost-effective manner in such a design, by means of milling for instance. The guide area on the plunger can be embodied in the form of a simple flat portion.

In one embodiment, the first slot-shaped guide groove is designed to be parallel to the longitudinal axis of the pump piston. The slot-shaped guide groove which is designed to be parallel to the longitudinal axis of the pump piston is particularly easy to produce in terms of manufacturing. Furthermore, a particularly efficient and non-jamming guidance of the plunger is ensured by means of the parallel design of the guide groove. The parallel design of the guide groove ensures that the entire width of the roller rests against the camshaft. A skewed and consequently unfavorable load transmission is thus prevented in an effective manner.

A further embodiment provides for the roller of the roller plunger to be guided in a second slot-shaped guide groove of the cylinder insert. This produces a particularly reliable guidance of the roller plunger.

A further embodiment provides for the second slot-shaped guide groove to be arranged at right angles to the first slot-shaped guide groove. The right-angled arrangement of the guide grooves to one another simplifies assembly of the roller plunger, since the roller plunger can herewith be inserted into the cylinder insert in two positions which are offset from one another by 180 degrees.

In accordance with an embodiment, a return spring is preferably arranged between the cylinder insert and the roller plunger. The return spring allows the roller plunger to be kept in constant contact with the camshaft during the pump operation. This prevents the roller plunger lifting away from the camshaft. The action of the roller plunger lifting off the camshaft and then dropping back onto it again would otherwise result in significantly increased wear to the roller plunger and the camshaft.

In accordance with an embodiment, contact surfaces for the return spring are preferably formed on the cylinder insert and the roller plunger in each instance. These contact surfaces allow the return spring to be fixed in a simple fashion. Furthermore, this simplifies the assembly of the return spring.

A further embodiment provides for the roller plunger to include a disk which serves to accommodate the return spring. The disk is embodied here such that its inner circumference is guided on the outer circumference of the cylinder insert. To this end, a slight play is present between the disk and the cylinder insert.

A further embodiment provides for the plunger to include a fork-shaped recess, between which the roller of the roller plunger is mounted in a rotatable manner by means of a roller bolt. The fork-shaped recess enables the roller to be fastened to the roller plunger in a particularly simple manner. In addition, the roller can be connected to the plunger in a simple fashion by way of a roller bolt. In this way, the roller bolt enables the rotatable arrangement of the roller in the plunger.

A further embodiment provides for the plunger to be connected to the pump piston in a form-fit manner. The form-fit connection ensures a particularly simple and reliable connection between the plunger and the pump piston even with high pressure and high rotational speeds.

A further embodiment provides for the plunger to include a T-groove, which forms the form-fit connection using a shoulder embodied on the pump piston. Such a T-groove can be formed in the plunger in a relatively simple manner and advantageously ensures a simple and reliable assembly.

The concept underlying the radial piston pump according to an embodiment is to prevent the plunger from twisting along its longitudinal axis by embodying a guide area on the plunger with which its is guided in a first slot-shaped guide groove of the cylinder insert. Such an embodiment is the first to effectively prevent the plunger from twisting and thereby enables damage caused to the radial piston pump to be reduced. The twist-proof arrangement of the plunger means that the radial piston pump is particularly suited to high rotational speeds, such as for instance occur with high-pressure fuel pumps, for which the present invention is particularly suited.

FIG. 1 shows a radial section through a radial piston pump. The radial piston pump essentially consists of a cylinder insert 4 in a pump housing 1 and two cylinders inserts 4 offset against each other at an angle of 90 degrees. Each cylinder insert 4 features a cylinder space 21, in which a pump piston 3 is arranged such that it can be moved to and fro in each instance. The pump piston 3 is driven by a camshaft 5 by way of a roller plunger 6. Here, the camshaft 5 can comprise one or a number of cams. The roller plunger 6 includes a plunger 7, a roller 8 and a roller bolt 18. The plunger features a fork-shaped recess 17 for accommodating the roller 8. The roller 8 is arranged in a rotatably mounted manner between the fork shafts with the aid of a roller bolt 18. The plunger 7 features a guide area 9, with which said plunger is guided in a first slot-shaped guide groove 10 of the cylinder insert 4 (see also FIGS. 3 and 4). The first slot-shaped guide groove 10 is preferably designed to be parallel to the longitudinal axis of the pump piston 3. This ensures reliable guidance of the roller plunger 6. The guide groove 10 which is designed to be parallel to the longitudinal axis of the pump piston 3 can be introduced into the cylinder insert 4 in a simple manner, by means of milling for instance.

The plunger 7 is particularly preferably connected to the pump piston 3 in a form-fit manner. To this end, the plunger 7 features a T-groove 19, which forms the form-fit connection with a shoulder 20 formed on the pump piston 3. The form-fit connection ensures a reliable connection between the roller plunger 6 and the pump piston 3 even with high rotational speeds of the radial piston pump. In addition, a particularly simple assembly of the two components results from the T-groove.

To ensure that the roller plunger 6 and the pump piston 3 are constantly in contact with the camshaft 3 during the pump operation, a return spring 13 is arranged between the cylinder insert 4 and the roller plunger 6. To this end, the roller plunger 6 and the cylinder insert 3 comprise specially designed contact surfaces 14, 15. The roller plunger 6 is contacted particularly preferably by way of a disk 16 resting against the plunger 7. The disk 16 is designed here such that it is arranged on the outer periphery of the cylinder insert with slight play.

Figure 2:
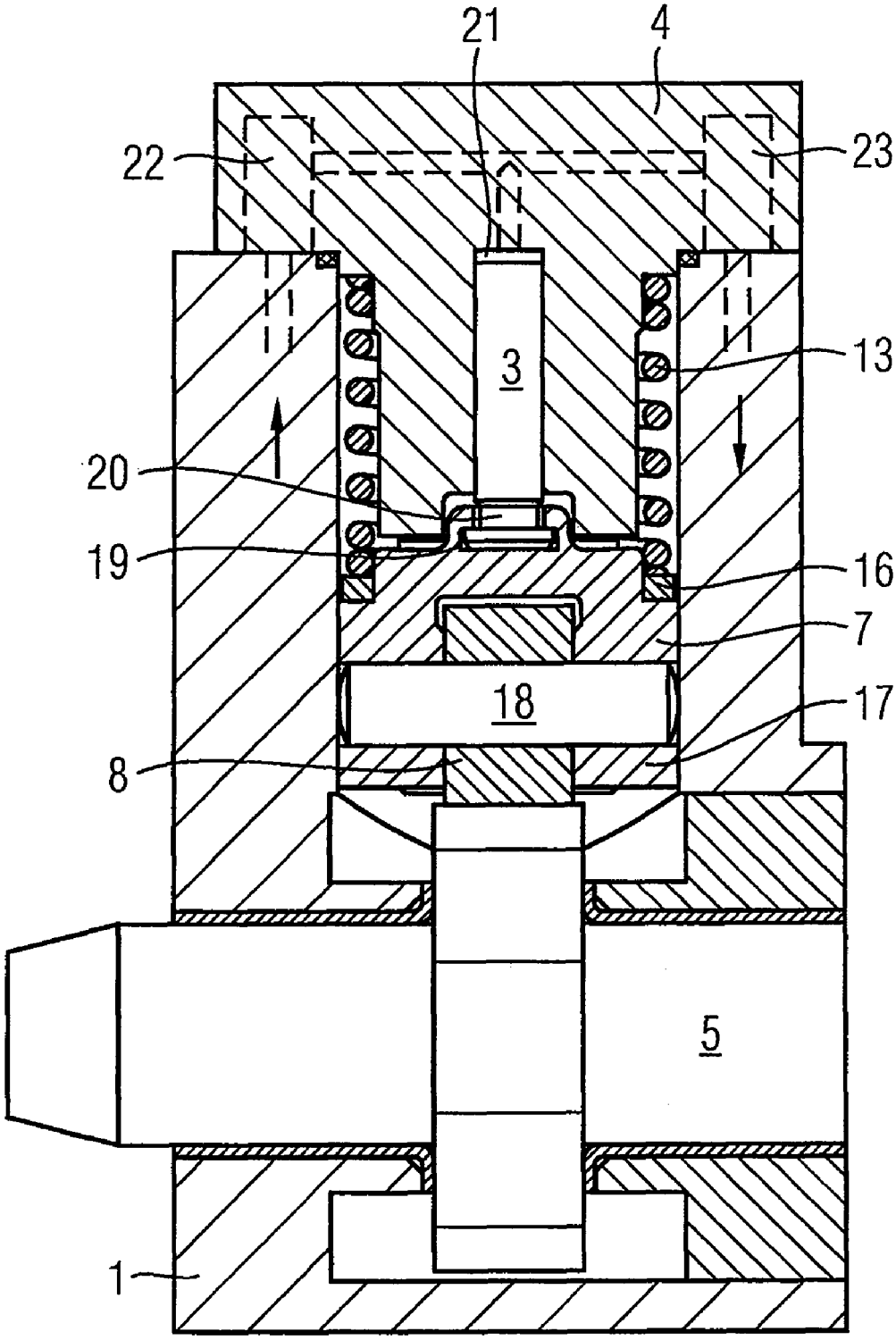
FIG. 2 shows a schematic axial section through the radial piston pump shown in FIG. 1.

The mode of operation of the radial piston pump can be seen from FIG. 2. It essentially equates to the function of conventional radial piston pumps with a guide shoe arrangement. During the intake stroke of the pump piston 3, the fuel enters the cylinder space 21 by way of a suction valve 22, leaves the cylinder space 21 following the compression by way of a high-pressure valve 23 and is fed to a high-pressure accumulator (not shown).

The form-fit connection of the roller 8 with the plunger 7 is particularly apparent in FIG. 2. To this end, the plunger 7 features a fork-shaped recess 17. The roller 8 is mounted in a rotatable manner between the fork shanks of the recess 17 with the aid of a roller bolt 18. Each fork shank features a recess bore for the purpose of accommodating the roller bolt 18. In this recess bore, the roller bolt 18 is fastened with an interference fit so that the components are arranged in a captive manner.

Figure 3:
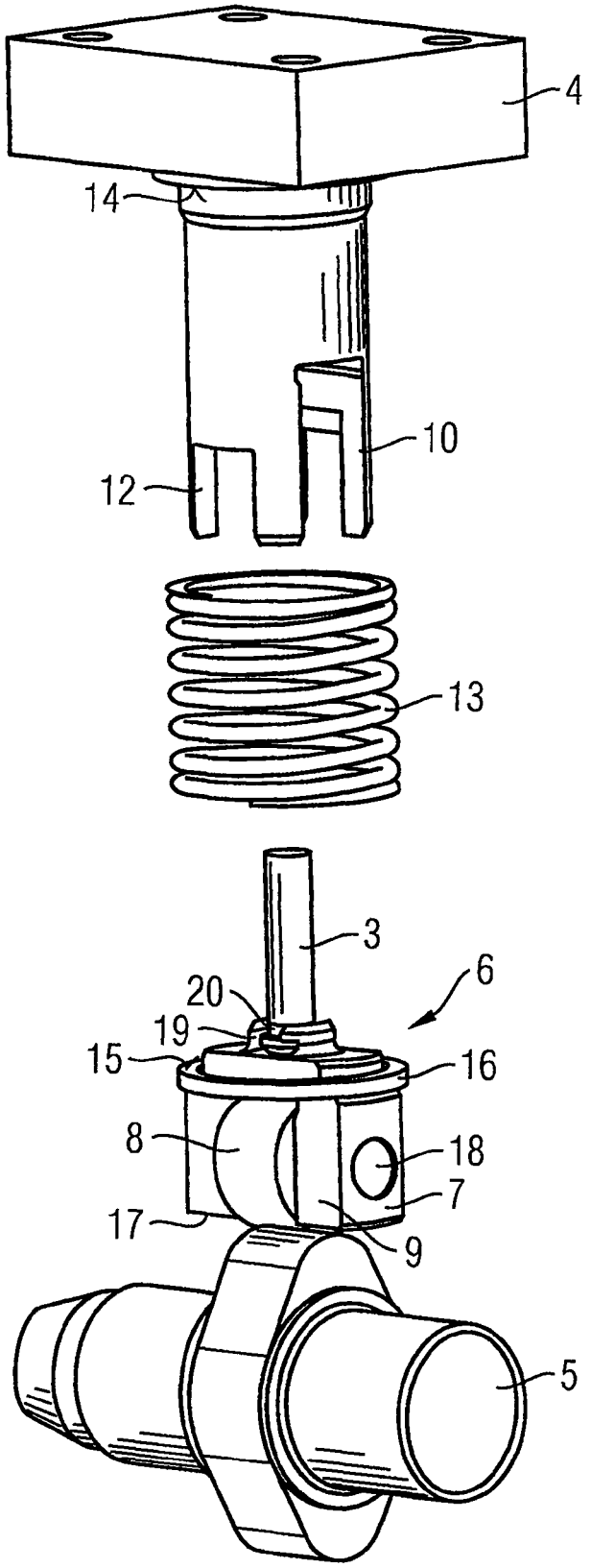
FIG. 3 shows a schematic three-dimensional exploded view of the radial piston pump shown in FIGS. 1 and 2.

FIG. 3 shows a three-dimensional exploded view of the radial piston pump shown in FIGS. 2 and 2. This gives a particularly good view of the guidance of the roller plunger 6 in the cylinder insert 4. To this end, the plunger 7 has a guide area 9, with which said plunger is guided in a first slot-shaped guide groove 10 of the cylinder insert 4. Because of this guide the plunger 7 is prevented from twisting about its longitudinal axis. The slot-shaped guide groove 10 is designed to be parallel to the longitudinal axis of the pump piston 3. The design parallel to the longitudinal axis is particularly advantageous in manufacturing terms. Another design of the guide groove 10 is however naturally also possible.

The roller 8 is guided in a second slot-shaped guide groove 12 of the cylinder insert 4. Safeguarding against twisting is herewith further increased.

Figure 4:
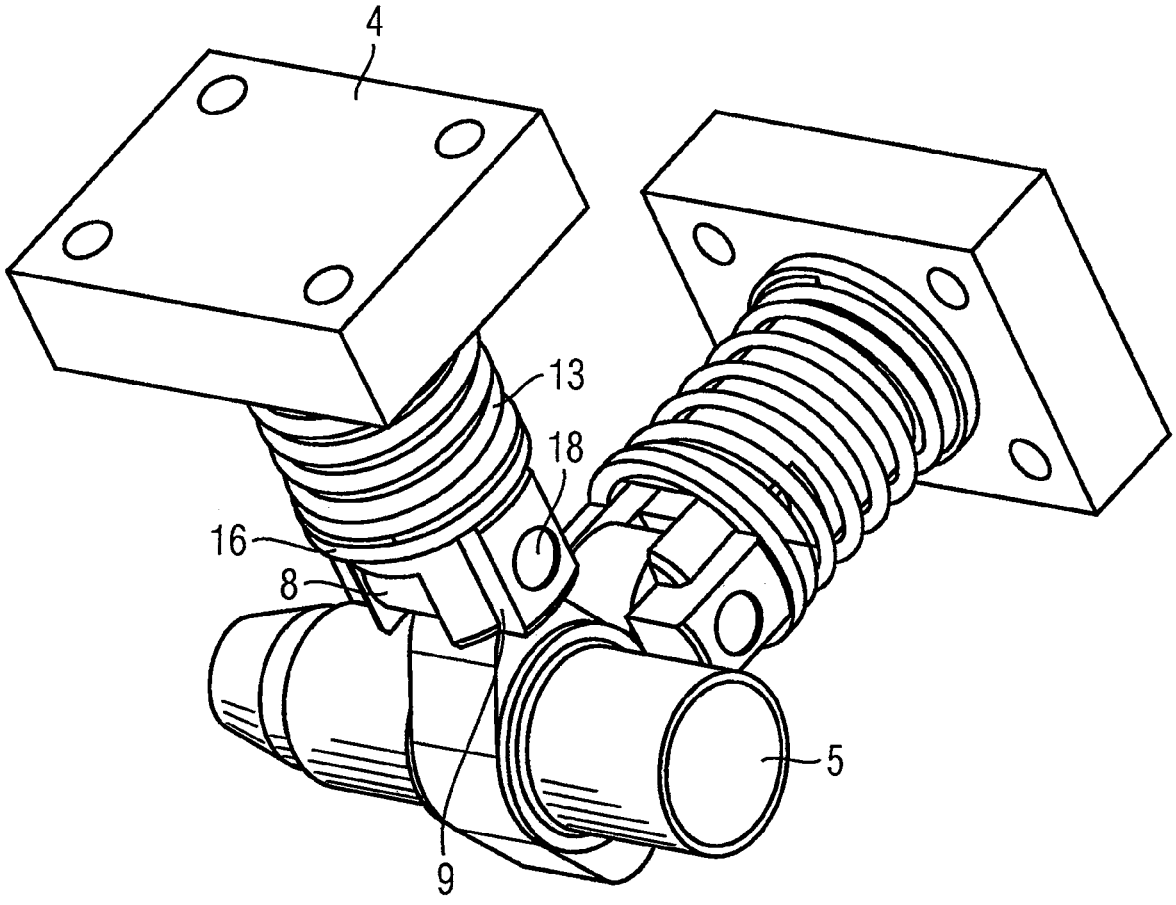
FIG. 4 shows a schematic three-dimensional representation of the radial piston pump shown in FIGS. 1 to 3 in an assembled state.

FIG. 4 shows the radial piston pump in a three-dimensional representation in an assembled state. The pump housing is not shown in this figure in order to improve clarity. The guidance of the plunger 7 in the cylinder insert 4 is shown particularly well again in the figure. In particular, it is also apparent from the figure that the disk 16 for accommodating the return spring 13 rests on a shoulder of the plunger 7 and is guided on the outer circumference of the cylinder insert 4.

The radial piston pump is preferably of a modular design. This means that the pump units 2 can essentially be preassembled as autonomous components prior to assembly of the radial piston pump.

The fact that a plunger is embodied with guide areas, which are guided in at least one slot-shaped guide groove, reliably prevents the roller plunger from twisting. This considerably increases the operational reliability of the radial piston pump compared to the prior art. In particular, the radial piston pump is especially suited to high rotational speeds, as occur for instance with high-pressure fuel pumps, for which the present invention is particularly suited.

What is claimed is:

1. A radial piston pump, having a pump housing and at least one pump unit comprising a pump piston and a cylinder insert in which the pump piston is mounted such that the pump piston can be moved back and forth, wherein the pump unit is configured to be driven by means of a camshaft mounted in the pump housing, wherein a roller plunger comprising a plunger and a roller is arranged between the camshaft and the pump unit, wherein the plunger comprises a guide area configured to guide said plunger in a first slot-shaped guide groove of the cylinder insert, and wherein the roller is guided in a second slot-shaped guide groove of the cylinder insert.

2. The radial piston pump according to claim 1, wherein the first slot-shaped guide groove is designed to be parallel to the longitudinal axis of the pump piston.

3. The radial piston pump according to claim 1, wherein the second slot-shaped guide groove is arranged at right-angles to the first slot-shaped guide groove.

4. The radial piston pump according to claim 1, wherein a return spring is arranged between the cylinder insert and the roller plunger.

5. The radial piston pump according to claim 4, wherein a contact surface for the return spring is embodied in each instance on the cylinder insert and on the roller plunger.

6. The radial piston pump according to claim 4, wherein the roller plunger includes a disk, which serves to accommodate the return spring.

7. The radial piston pump according to claim 1, wherein the plunger features a fork-shaped recess, between which the roller of the roller plunger is mounted in a rotatable manner by means of a roller bolt.

8. The radial piston pump according to claim 1, wherein the plunger is connected to the pump piston in a form-fit manner.

9. The radial piston pump according to claim 8, wherein the plunger features a T-groove, which forms the form-fit connection with a shoulder formed on the pump piston.

10. A radial piston pump, comprising:

a pump housing and at least one pump unit with a pump piston and a cylinder insert in which the pump piston is mounted such that the pump piston can be moved back and forth, a camshaft mounted in the pump housing for driving the pump unit, a roller plunger comprising a plunger and a roller, the roller plunger arranged between the camshaft and the pump unit, the plunger comprising a guide area configured to guide said plunger in a first slot-shaped guide groove of the cylinder insert, and the roller is guided in a second slot-shaped guide groove of the cylinder insert.

11. The radial piston pump according to claim 10, wherein the first slot-shaped guide groove is designed to be parallel to the longitudinal axis of the pump piston.

12. The radial piston pump according to claim 10, wherein the second slot-shaped guide groove is arranged at right-angles to the first slot-shaped guide groove.

13. The radial piston pump according to claim 10, wherein a return spring is arranged between the cylinder insert and the roller plunger.

14. The radial piston pump according to claim 13, wherein a contact surface for the return spring is embodied in each instance on the cylinder insert and on the roller plunger.

15. The radial piston pump according to claim 13, wherein the roller plunger includes a disk, which serves to accommodate the return spring.

16. The radial piston pump according to claim 10, wherein the plunger features a fork-shaped recess, between which the roller of the roller plunger is mounted in a rotatable manner by means of a roller bolt.

17. The radial piston pump according to claim 10, wherein the plunger is connected to the pump piston in a form-fit manner.

18. The radial piston pump according to claim 17, wherein the plunger features a T-groove, which forms the form-fit connection with a shoulder formed on the pump piston.

19. A radial piston pump, comprising:

a pump housing and at least one pump unit with a pump piston and a cylinder insert in which the pump piston is mounted such that the pump piston can be moved back and forth, a camshaft mounted in the pump housing for driving the pump unit, a roller plunger comprising a plunger and a roller, the roller plunger arranged between the camshaft and the pump unit, the plunger comprising a guide area configured to guide said plunger in a first slot-shaped guide groove of the cylinder insert, and a return spring arranged between the cylinder insert and the roller plunger.

* * * * *

UNITED STATES PATENT AND TRADEMARK OFFICE

CERTIFICATE OF CORRECTION

PATENT NO. : 7,762,176 B2
APPLICATION NO. : 11/576798
DATED : July 27, 2010
INVENTOR(S) : Ngoc-Tam Vu It is certified that error appears in the above-identified patent and that said Letters Patent is hereby corrected as shown below:

Title page, Item [86] Please correct the PCT No. as follows:

PCT/EP2005/053671

Signed and Sealed this

Fifth Day of October, 2010

David J. Kappos

David J. Kappos
*Director of the United States Patent and Trademark Office*